US005303998A

United States Patent [19]

Whitlatch et al.

[11] Patent Number: 5,303,998

[45] Date of Patent: Apr. 19, 1994

[54] METHOD OF MIXING AND MANAGING OIL AND GAS WELL DRILLING FLUIDS

[76] Inventors: Blake Whitlatch, 6067 Chateau Loire, Mandeville, La. 70448; David A. Barrow, 10622 Allyson, Baton Rouge, La. 70815

[21] Appl. No.: 885,947

[22] Filed: May 19, 1992

[51] Int. Cl.[5] ..... B28C 5/06

[52] U.S. Cl. ..... 366/3; 366/37; 366/181; 222/394

[58] Field of Search ..... 414/608; 222/394; 406/120, 146; 366/1-3, 5, 6, 8, 10, 11, 13, 16, 33, 101, 139, 150, 162, 177, 181, 182, 37

[56] References Cited

U.S. PATENT DOCUMENTS

| | | | |
|---|---|---|---|
| 2,073,779 | 3/1937 | Bramsen | 366/162 X |
| 3,580,643 | 5/1971 | Spitzer | 406/146 X |
| 3,627,275 | 12/1971 | Gusmer | 366/146 |
| 3,762,773 | 10/1973 | Schroeder | 406/146 X |
| 3,782,695 | 1/1974 | Sandiford | 366/139 X |
| 3,902,558 | 9/1975 | Watson, Jr. | 366/101 X |
| 4,801,210 | 1/1989 | Gian | 366/10 X |

FOREIGN PATENT DOCUMENTS

| | | | |
|---|---|---|---|
| 658053 | 4/1979 | U.S.S.R. | 406/146 |

*Primary Examiner*—Harvey C. Hornsby
*Assistant Examiner*—Charles Cooley
*Attorney, Agent, or Firm*—Pravel, Hewitt, Kimball & Krieger

[57] ABSTRACT

A method of mixing drilling fluids at a drill site includes the transportation of sealed silo assemblies that can contain dry products in bulk to the well drilling site. The dry products are maintained within the silo assemblies in a dry and pressurized condition. The dry product is discharged from the sealed silo assemblies and into a mixer at the well drilling site wherein the mixer is maintained in a sealed environment until mixing is completed. The mixer combines the dry product with a liquid at the well site. The dry product is maintained within the silo assemblies in a pressurized condition to discourage the entry of moisture or gasses having high moisture content.

9 Claims, 4 Drawing Sheets

METHOD OF MIXING AND MANAGING OIL AND GAS WELL DRILLING FLUIDS

BACKGROUND OF THE INVENTION

1. Field of the Invention

The present invention relates to oil and gas well drilling and more particularly relates to the management of oil and gas well drilling fluids. Even more particularly, the present invention relates to a method and apparatus for transporting bulk quantities of dry drilling material to and from an oil and gas well drilling structure and wherein an improved silo apparatus is used for transporting drilling additives to the well drilling site in dry powder form, and the handling of such dry material in dust-free form, using inert gas to both preserve the dry product and to transmit the dry product from the silo, and wherein the silos are maintained in a positive pressure and in arid condition to prevent moisture from entering the silo.

2. General Background

There are many dry powder products used as drilling mud components. Many of these products are extremely reactive in the presence of moisture. Some of these dry powders such as barite (a mined ore) are not affected by moisture. Other products such as XCD-Polymer are extremely hydrophilic and must be shipped in small packages, sacks, or the like which are expensive to produce and a nuisance once empty. When alternate forms of transportation for these polymers have been attempted, the best attempt at a solution has been to slurry them in nonpolar, environmentally hazardous liquid carrier and transport them to the drilling location via a liquid bulk tank.

Manufacturers spend a large amount of time and money in the handling of equipment and personnel to place such dry products in sacks or bags and to load those onto a drilling rig at significant cost to the end user. Once sacks or bags are filled with such dry material, they are typically loaded onto wooded pallets or the like and then shrink-wrapped with a plastic film for protection against the elements. The shrink-wrap is very expensive and can be easily torn or punctured exposing the product to the environment, sometimes resulting in damage or destruction of the product before end use. Often times the damage is discovered at a critical time when the ruined inventory is needed for maintaining a rig operating condition.

Palletized materials are handled with fork trucks and cranes in transporting those materials from the source, through vehicles and vessels to the well drilling site. Palletized material is often placed upon a large work vessel for marine transport. Palletized drilling materials can be damaged by the fork truck, the crane, or by improper handling techniques. Sometimes, the damage is not noticed and the product is shipped with all attentive expense to the drilling site in damaged condition. This commonly happens when a forklift operator damages sacks of material which are loaded onto a pallet and never notices the damage until the product is unloaded from the pallet on the drill rig.

If the product is delivered to a land based drilling rig, it will be off loaded using a forklift. The land location is often surrounded by wooden board roads in some locations, thus making fork truck operation more difficult. Entire pallets of products have been dropped due to unstable conditions on such wooden board roads.

If palletized drilling products arrive at a sea port, they are generally off loaded by a crane. The equipment used to pick up the pallets has tongues which slide under the pallet with cables and straps. When the lift is made, the cable becomes tight and can cut through the shrink wrap into the paper sacks. In situations such as this, the product is then exposed to the elements and can become moist or simply drain out of the sacks after the damage is done. Sometimes, if many sacks are punctured during lifting operations, the load can become imbalanced and the entire pallet of packaged product can be spilled and lost. Bodily injury can occur as a result of such accidents. In rough seas, the unloading of palletized bags of dry drilling material can take hours adding greatly to the expense of shipping and handling.

In heavy seas, waves can wash over the side of the boat creating a potential water damage problem for these dry powder drilling materials. When product is damaged on the way out to sea and to the drilling rig, it is damage that is not always discovered until the vessel arrives, creating a waste of time and money for the boat operator and for the rig operator. If damaged inventory is extensive, insufficient mud production can shut down drilling operations with enormous associated cost to the operator.

Once a work boat arrives on location, the product must be lifted by crane onto the drilling rig, one pallet at a time. Sometimes, the pallets that are needed for a particular job are the last ones to be unloaded from the vessel because the vessel is unloaded in reverse order. If a particular product is urgently needed, it may not be able to be obtained until several hours of unloading have passed.

When dry packaged drilling products do arrive on location, they are typically stored and sometimes for an extended period of time before use. On land drilling locations, the pallets are stacked in the most convenient spot on the board road. Offshore, such sacks of dry material occupy any available deck space. When a particular product is needed, a pallet load of that product is located and positioned near an appropriate hopper using a fork truck or crane and in some cases hand carrying is used.

At the particular hopper, the sacks of dry material must literally be cut open by hand and dumped. This is an unsafe process with many inherent risks. Back injuries, lacerations, and dust irritation are common problems associated with the handling of twenty-five to one hundred pound sacks of dry drilling material.

Once all the dry material is added to the hopper, the empty sacks are collected and placed in a trash bin along with shrink wrap, broken wooden pallets, all of which must be returned to shore for disposal at additional expense. A source of environmental concern is that waste is lost at sea due to weather conditions or deliberately cast off to avoid disposal cost. This creates a pollution problem for the open seas and the shore lines. It has been estimated that ten percent of the average total of dry material cost is due to lost product through mishandling and weather conditions and related damage.

SUMMARY OF THE PRESENT INVENTION

The present invention provides a method of mixing drilling fluids at a drill site that includes the transportation of a sealed silo assembly to the drill site that contains dry product in bulk form.

The dry product is maintained within the interior of the silo in a dry arid condition and also pressurized. The pressurized condition prevents the entry of moisture during long term storage.

The product is discharged at the well site. The mixer is maintained in a sealed environment until mixing is completed.

In the mixer, the dry material that is discharged from the silo assembly is combined with a liquid product for use as drilling mud or a drilling mud additive.

The apparatus of the present invention provides a dispensing apparatus for combining dry material with a wetting agent at an oil and gas well drilling site. The apparatus includes a transportable frame with a vessel contained protectively within the confines of the frame. The vessel includes a larger upper end portion and a smaller lower end portion.

An outlet is provided for discharging dry drilling material from the vessel interior. The lower end portion of the vessel is shaped to concentrate dry material within the tank to a position adjacent the outlet. A header for fluidizing the dry material at the outlet connects at first and second end portions respectively with the larger end of the vessel and the smaller end of the vessel at the outlet. The header includes a quick release connection for connecting a source of pressurized gas to the header and valves allow selective controlling of the flow of pressurized gas within the header to either the first or second end portion thereof.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
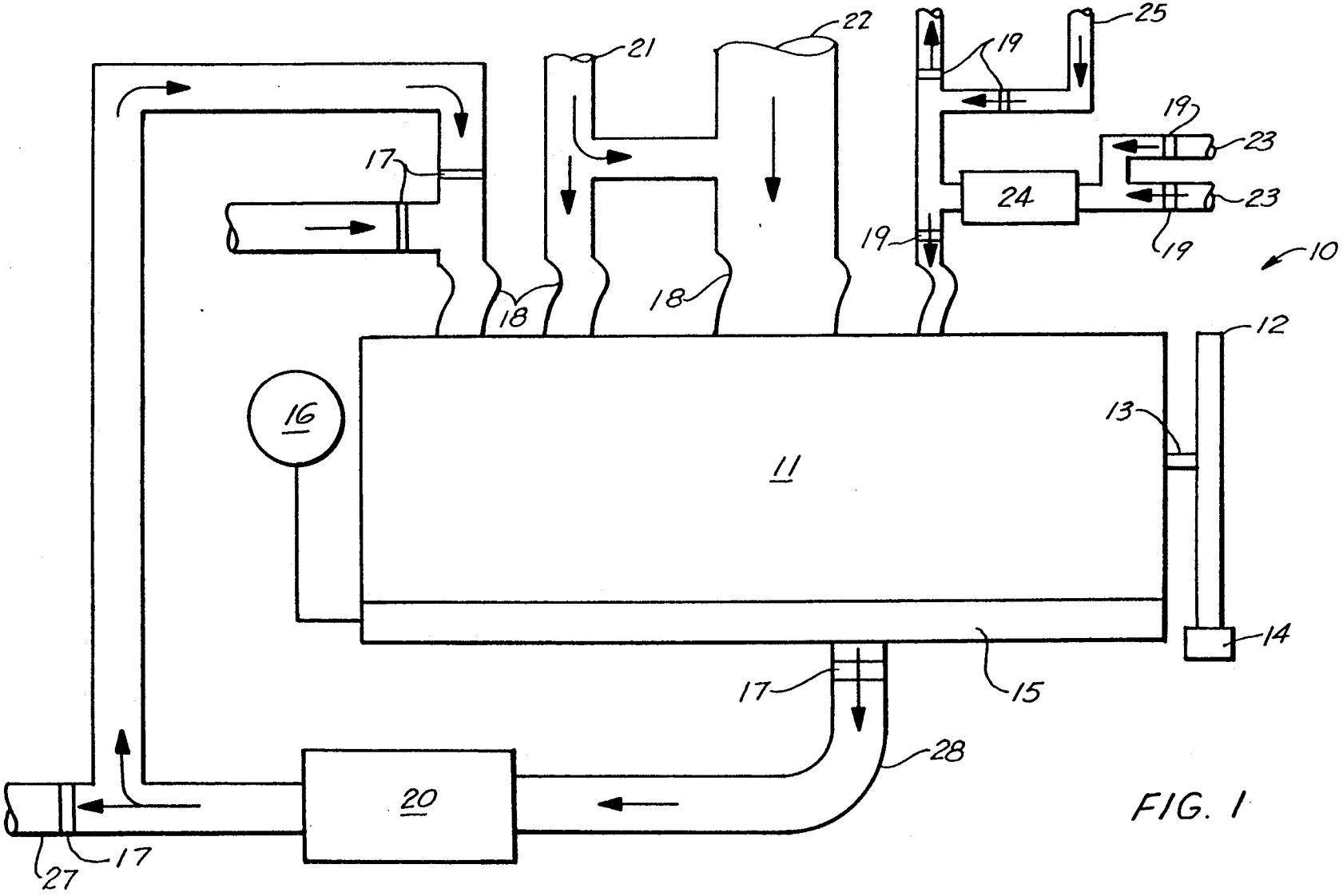
FIGS. 1-1A are schematics view of the system of the present invention.
Figure 1A:
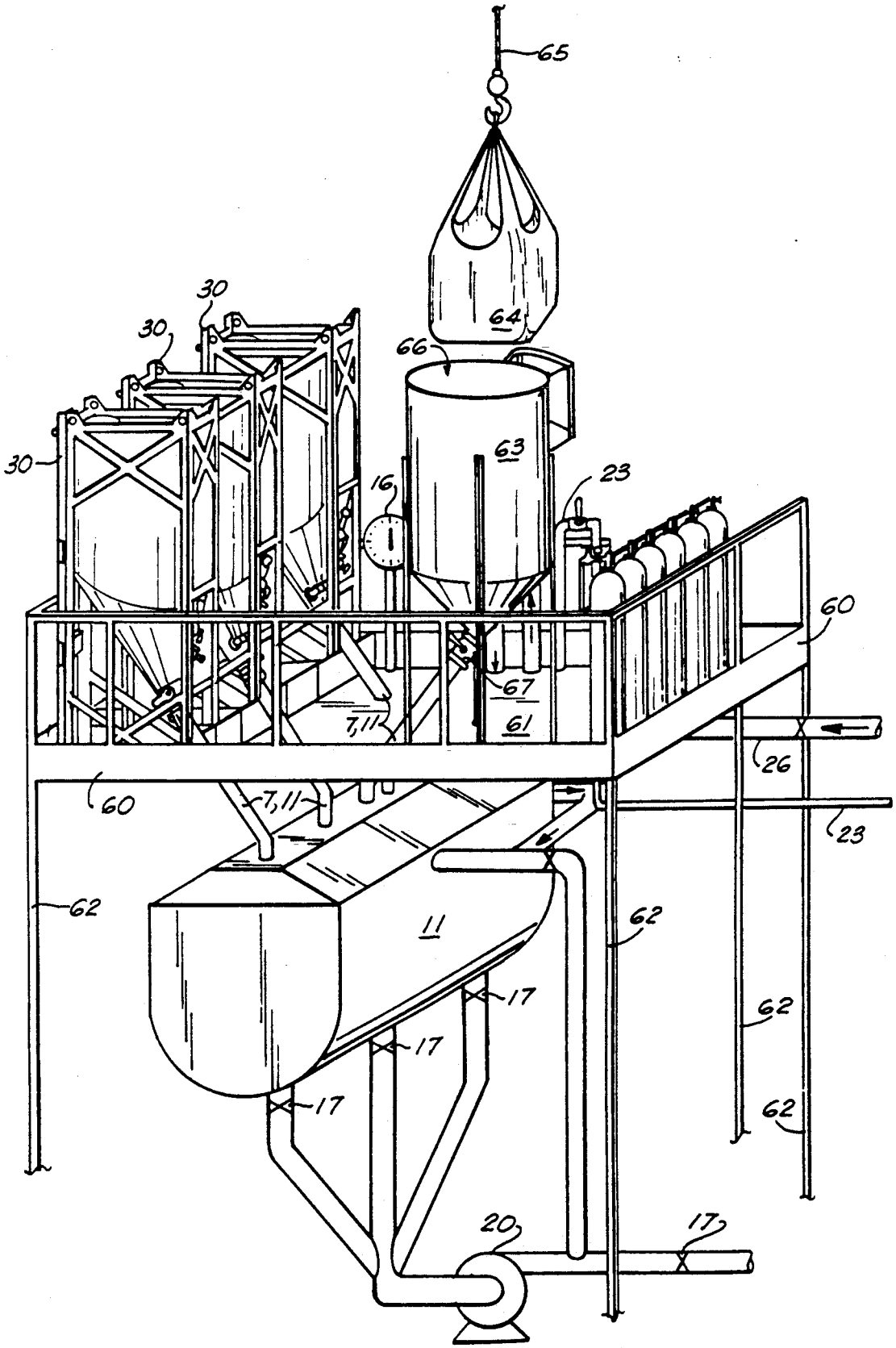
Figure 3:
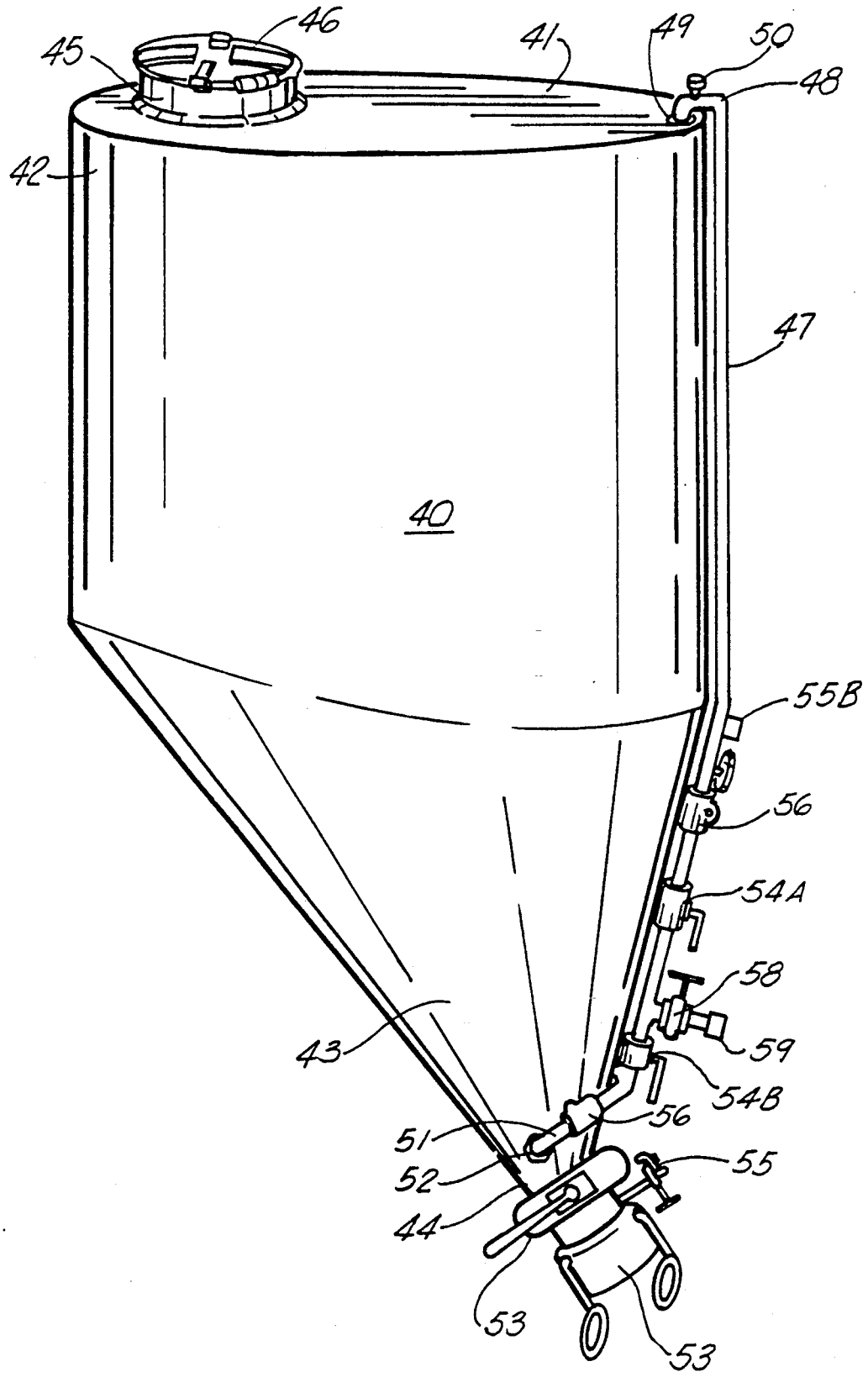
FIG. 3 is a perspective fragmentary view illustrating the vessel portion of the preferred embodiment of the apparatus of the present invention.

In FIGS. 1-1A, there can be seen schematic flow diagrams of the system of the present invention designated generally by the numeral 10. In FIG. 3, there is first seen at the center thereof a large horizontal batch mixer 11. Mixer 11 (commercially available) is preferably fitted with abrasive resistent paddle agitators to provide a complete clean-out. Mixer 11 has an outer tank made of abrasive resistent steel useful for example for mixing sand.

Heavy duty stuffing boxes can be provided to mixer 11 for preventing material from getting into the main bearings. The capacity of the mixer 11 would be for example 100–550 cubic feet (17.8–98 barrels) and ready to mix one hundred pounds per cubic foot of slurry. As an example, a mixer capacity 150 cubic feet would be rated to one hundred pounds per cubic foot equals fifteen thousand pounds of cement slurry at seventeen pounds per gallon.

Mixer 11 is preferably sealed during use, with a lid for viewing. When sealed, Mixer 11 provides for dust-free dumping. Protective guard 12 houses a gear box for controlling operation of the mixing agitators which are not shown but are connected to drive shaft 13. Electric motor 14 interfaces with the gear box to provide power that will rotate drive shaft 13 and drive the agitator. An electric motor 14 such as for example 30–100 horse power is an example.

Mixer 11 is mounted upon beam scale 15 for electric free weighing. Mechanical scale 16 reads an accurate tenth of a percent to two pounds per ton. Mechanical scale 16 would be commercially available. Butterfly valves 17 control discharge of each batch from mixer 11. A total of four valves 17 are illustrated in the embodiment of FIG. 1. Flexible hoses 18 are used to interface hard piping to mixer so as to prevent interference with the weighing process.

A plurality of valves 19 as shown in FIG. 1 are used to direct the flow of water and other liquids into the mixer 11. A pump 20 that is capable of pumping very high viscous slurry can be a commercially available pump that handles a rate of for example five barrels per minute. Slurry can be discharged from mixer at varying rates by operating the butterfly valves 17 as a control. An existing drilling rig bulk system 21 can be employed to add barite, gel, or cement, the bulk system being designated generally by the numeral 21.

Dry product feed flume 22 allows dry product to be added to mixer 11. Flow line 23 can be used to add drill water and/or sea water for mixing. Meter 24 indicates the exact amount of water added to the mixer 11. Liquid product additive line 25 allows the addition of any liquid product to the mixer. Line 26 delivers drilling mud to the mixer and line 27 delivers the slurried product to its destination elsewhere on the rig. Pump 20 includes an intake side that communicates with discharge line 28 from mixer 11 and an output or discharge side that communicates with the output flow line 27.

In FIG. 1A, a schematic, perspective view illustrates the system of the present invention in use on an elevated oil/gas well drilling platform such as for example in an offshore environment. The rig platform 60 provides a deck area 61 with mixer 11 mounted under the deck 61 and structurally supported using steel beams, trusses or the like. The rig platform 60 includes a plurality of vertically standing legs 62 which can be hundreds of feet in length for example, extending to the ocean floor. Hopper 63 corresponds generally to product feed flume 22 of FIG. 1. The use of the hopper 63 allows a selected drilling material to be added in bulk using large bags 64 and lifting assembly 65. Hopper 63 thus provides an open top 66 into which bulk material can be added for transfer as needed to the mixer and controlled by valve 67.

The following table lists materials that are reactive in the presence of water and which would desireably be handled in a dry, pressurized environment with the silo assembly 30.

TABLE 1

| PRODUCT | DESCRIPTION |
|---|---|
| Calcium Carbonate | |
| Salt Gel | |
| Oil Mud Gel | Amine Treated Clay |
| Lime | Calcium Hydroxide |
| Caustic | Sodium Hydroxide |
| Soda Ash | Sodium Carbonate |
| Bicarb | Sodium Bicarbonate |
| KOH | Potassium Hydroxide |
| Gypsum | Calcium Sulphate |
| Desco | Organic Thinner/ Modified Tannin |

TABLE 1-continued

| PRODUCT | DESCRIPTION |
|---|---|
| Lignosulfonate | Chrome/Chrome Free |
| Lignite | Lignite |
| SAPP | Sodium Acid Pyrophosphate |
| Calcium Lignosulfonate | |
| PHPA | Partially Hydrolyzed Polyacrylamide |
| XCD | Bacterial Gums Polysaccharide |
| Drispac | Polyanionic Cellulose |
| CMC | Carboxymethyl Cellulose |
| Starch | Polysaccharides |
| HEC | Hydroxyethyl Cellulose |
| Resinex | Co-Polymer of a Sulfonated Lignite |
| Asphalt | Asphalt |
| Soltex | Sulfonated Asphaltines |
| Gilsonite | Gilsonite |

There are other products that could be handled by insertion into hopper 63 and which could be added to mixer 11 using bag 64 for example. These would include products that are not as sensitive to water such as for example Barite, Hematite, Gel (Wyoming Bentonite) Salt Gel (Attapulgite), Sodium Chloride, walnut shells, Cylicates, peanut shells, spun rock, coke, Kwik-Seal ® (comprised of granules, flakes, and fibers).

Figure 2:
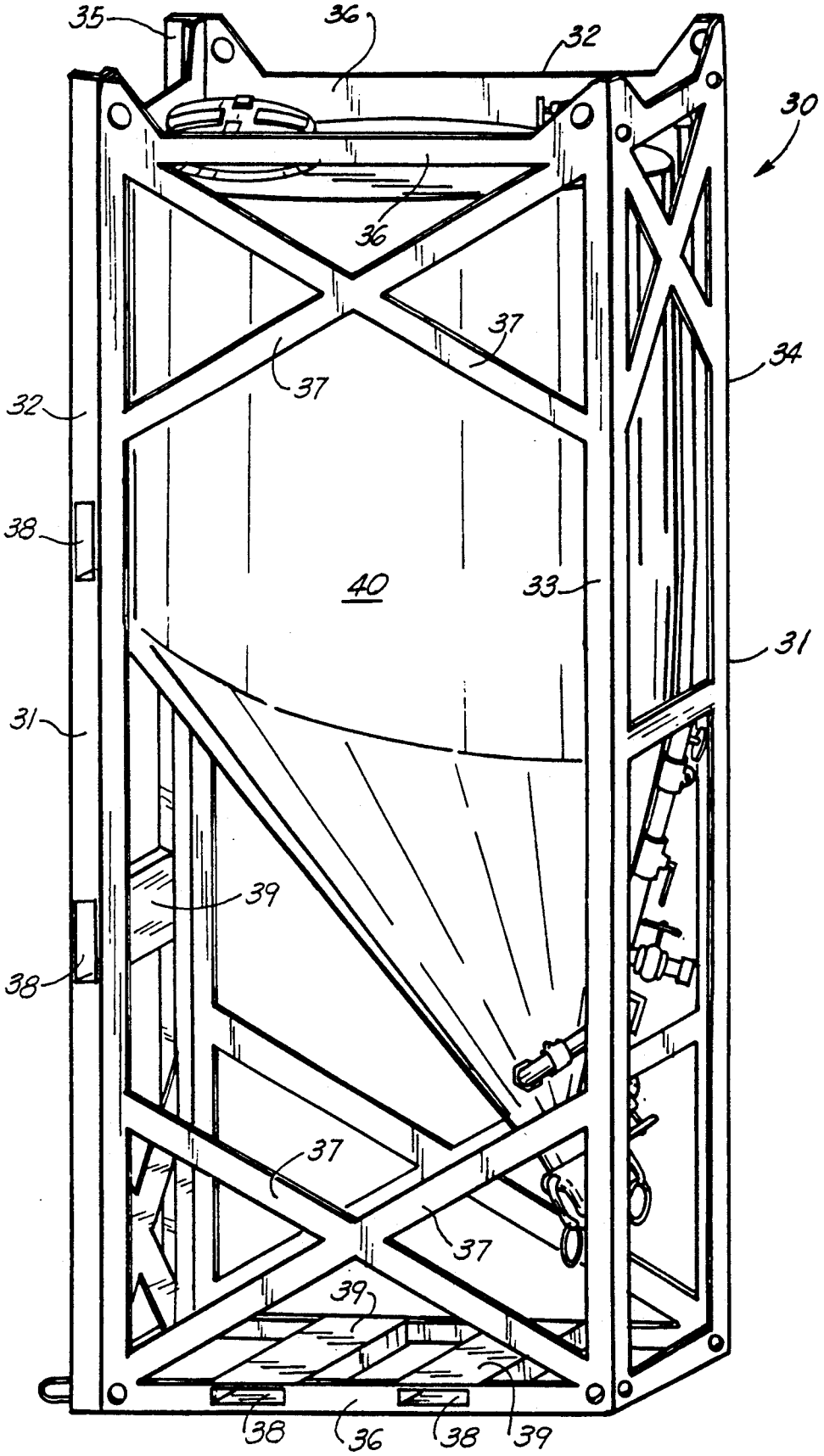
FIG. 2 is a perspective view of the silo assembly portion of the preferred embodiment of the apparatus invention.

In FIGS. 2 and 3, there can be seen silo assembly 30 for containing dry products typically used in the drilling of oil and gas wells. Silo assembly 30 includes a structural frame 31 (see FIG. 2) The frame 31 is comprised of longitudinal columns 32–35 and transverse members 36 and diagonal member 37. A plurality of forklift sockets 38 are provided in hollow channel beams 39 so that a forklift can lift the entire silo assembly 30 by engaging the sockets 38 with a pair of spaced apart forklift lifting tines on the bottom or side wall of frame 31.

Vessel 40 is contained within the confines of frame 31 in a protective fashion as shown in FIG. 2. Vessel 40 is shown more particularly in FIG. 3 with frame 31 removed. Vessel 40 includes a circular top 41, a cylindrically shaped upper portion 42 and a conically shaped lower end portion 43. A narrow lower outlet 44 communicates with cone shaped lower end portion 43 and defines a dispensing outlet. Circular top 41 carries a manway opening 45 and a cover 46 for sealing the manway opening 45.

Header 47 includes an upper end 48 that communicates with the interior of vessel 40 at inlet opening 49. Vessel 40 is hollow, being constructed of welded sheets of thin steel or the like. Pressure relief device 50 on header 47 prevents rupture of header 47 or vessel 40 due to over pressurization. Lower end 51 of header 47 communicates with the vessel 40 interior via inlet opening 52. Vessel outlet 44 carries a quick connect cap 53 so that a complete closure of the vessel interior can be maintained adjacent outlet 44.

Header 47 carries a pair of valves 54 that define the direction of flow of pressurized gas in header 47 in a selective fashion. By opening valve 54A and closing valve 54B, pressurized gas can be routed through header 47 to inlet 49 and thus the upper end 42 and inside vessel 40. This creates a pressurized environment within the vessel 40 interior during use. Pressurization of vessel 40 when valves 54A and valve 54B are closed also aids in emptying the contents of vessel 40 interior. In order to "fluff" the dry mixture contained with vessel 40, valve 54A is closed and valve 54B opened. This allows pressurized gas to enter vessel 40 interior adjacent outlet 44 via inlet 52.

Check valve 56 prevents a back pressure flow of pressurized gas through line 47 after vessel 40 interior has been pressurized. Similarly, check valve 56 prevents a backflow of pressure from the vessel interior via lower end 51 of header 47 when the vessel 40 interior is pressurized.

Pressure gauge 57 is used to create a desired pressure value inside vessel 40. Gate valve 58 closes the entire system including the pressure contained within header 47 and vessel 40 interior. Quick connect coupling 59 allows a source of pressurized gas such as pressurized nitrogen for example to be connected to the header for pressurizing the vessel 40 interior and the header 47 as aforedescribed. The pressurized gas is maintained at a desired pressure and is arid.

In order to utilize bulk quantities of oil and gas well drilling additives effectively, the dry product must be maintained in a flowing condition all the way into the drilling mud stream. Some dry additives will not flow as powder if they absorb moisture. When this happens, mixing becomes a problem because the bonding process has already started with the presence of water.

In a bulk mud protocol, the products will be loaded and transported to the job in the high volume silo assemblies 30. The hydrophilic products can be shipped in smaller silos (not shown). The high volume silo assemblies 30 can be stacked together neatly and safely and sit for indefinite periods of time, retaining product integrity until product is mixed or returned for credit.

The silo assemblies 30 will be emptied and gravity fed into batch mixer 11 The hydrophilic products can be added directly to the mixer 11. The scale mounted mixer 11 uses the mechanical scale 16 without the need for electronic parts. The scale 16 is capable of weighing from five to fifteen thousands pounds, accurate to one tenth of one percent for example. Thus, for every ton of additive placed into the mixture, the user knows within two pounds of how much inventory has been used.

The mixer 11 will be plumbed so that batches can be pumped wherever needed. This system thus allows the user to charge the mixer 11 with water or mud and up to thousands of pounds of any additive from any silo assembly 30. Mixer 11 will slurry the volume, lifting and tumbling the entire mass and circulating the entire contents from one end of the mixture to the other and at the same time up to many times per minute. This type of agitation is sufficient to thoroughly mix any polymer.

The present invention affords dust-free loading and mixing of products. The mixing tank 11 will be totally sealed so that the mixing will be dust-free. The bulk delivery loop is complete when any empty bags or silo assemblies 30 are returned to a stock point and recharged for the next visit to the drilling site.

The following table lists the part numbers and part descriptions as used herein and in the drawings attached hereto.

TABLE 2

| PART NO. | DESCRIPTION |
|---|---|
| 10 | system |
| 11 | mixer |
| 12 | gear box housing |
| 13 | drive shaft |
| 14 | electric motor |
| 15 | beam scale |
| 16 | scale |
| 17 | valves, butterfly |
| 18 | flexible hoses |
| 19 | gate valves |
| 20 | pump |

TABLE 2-continued

| PART NO. | DESCRIPTION |
|---|---|
| 21 | bulk system/hopper |
| 22 | product feed flume |
| 23 | water line |
| 24 | meter |
| 25 | flowline |
| 26 | drilling mud flowline |
| 27 | flowline |
| 28 | flowline |
| 30 | silo assembly |
| 31 | frame |
| 32 | longitudinal columns |
| 33 | longitudinal columns |
| 34 | longitudinal columns |
| 35 | longitudinal columns |
| 36 | transverse member |
| 37 | diagonal members |
| 38 | sockets |
| 39 | hollow channel beams |
| 40 | vessel |
| 41 | circular top |
| 42 | cylindrical upper portion |
| 43 | cone shaped lower end portion |
| 44 | narrow lower outlet |
| 45 | manway opening |
| 46 | cover |
| 47 | header |
| 48 | upper end |
| 49 | inlet |
| 50 | pressure relief device |
| 51 | lower end |
| 52 | inlet |
| 53 | quick connect cap |
| 54A, 54B | valves |
| 55A, 55B | pressure relief valves |
| 56 | check valve |
| 57 | pressure gauge |
| 58 | gate valve |
| 59 | quick connect coupling |
| 60 | rig platform |
| 61 | deck |
| 62 | leg |
| 63 | hopper |
| 64 | bags |
| 65 | lifting assembly |
| 66 | open top |
| 67 | valve |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of mixing oil and gas well drilling products, including hydrophilic dry products and fluids, at a drill site comprising the steps of:

a) transporting multiple sealed silo assemblies to the drill site silo having each a larger upper end portion and a smaller, generally cone-shaped lower end portion and each silo containing a dry, hydrophilic oil well drilling mud additive product;

b) maintaining the dry product within each silo in a dry and in a positive pressurized condition wherein the inside of each silo includes the dry product and a dry pressurizing gas product;

c) discharging the dry product from selected ones of the multiple silos into a mixer at the well drilling site using a combination of gravity flow and the positive pressure within each silo;

d) maintaining positive pressure in each silo at least until the silo is substantially empty;

e) maintaining the mixer in a sealed environment until mixing is completed; and f) wherein in step "e" the mixer combines the dry hydrophilic product with a liquid.

2. The method of claim 1 wherein the dry product is barite.

3. The method of claim 1 wherein the dry product is reactive in the presence of moisture.

4. The method of claim 1 wherein the dry product is a mined ore.

5. The method of claim 1 wherein the dry product is polymeric.

6. The method of claim 1 wherein in steps "e" and "f" a slurry is formed of the dry product and the liquid.

7. The method of claim 1 wherein the dry pressurizing gas product is inert gas.

8. The method of claim 1 or 7 wherein the gas product is nitrogen.

9. The method of claim 1 wherein in step "c" the pressurized gas at least in part discharges the dry product under pressure.

* * * * *